US006536702B1

(12) United States Patent
Vargo et al.

(10) Patent No.: US 6,536,702 B1
(45) Date of Patent: Mar. 25, 2003

(54) SURFACE WINDING ON AN A-FRAME WINDER

(75) Inventors: Richard David Vargo, Cuyahoga Falls, OH (US); Charles Terry Huffstetler, Union City, TN (US); Martin Lamar Sentmanat, Akron, OH (US)

(73) Assignee: The Goodyear Tire and Rubber Company, Akron, OH (US)

( * ) Notice: Subject to any disclaimer, the term of this patent is extended or adjusted under 35 U.S.C. 154(b) by 0 days.

(21) Appl. No.: 09/719,405

(22) PCT Filed: Jun. 10, 1998

(86) PCT No.: PCT/US98/11983

§ 371 (c)(1),
(2), (4) Date: Apr. 5, 2001

(87) PCT Pub. No.: WO99/64335

PCT Pub. Date: Dec. 16, 1999

(51) Int. Cl.[7] ..... B65H 18/08; B65H 18/26

(52) U.S. Cl. ..... 242/530.2; 242/541.3; 242/547

(58) Field of Search ..... 242/530.2, 533.8, 242/538.1, 535.4, 541.3, 541.5, 557, 541.6; 156/361, 395, 406

(56) References Cited

U.S. PATENT DOCUMENTS

| | | | | |
|---|---|---|---|---|
| 1,955,741 A | | 4/1934 | Eitzen | |
| 3,012,735 A | * | 12/1961 | Nebout | 242/530.2 |
| 3,098,619 A | | 7/1963 | Washburn | |
| 3,623,677 A | * | 11/1971 | Appleby et al. | 242/530.2 |
| 3,946,960 A | * | 3/1976 | Hunter | 242/530.2 |
| 4,283,023 A | | 8/1981 | Braun et al. | |
| 4,365,676 A | | 12/1982 | Benthimere | |
| 4,695,005 A | * | 9/1987 | Gietman, Jr. | 242/535.4 |
| 4,746,076 A | | 5/1988 | Tomma et al. | |
| 4,764,076 A | | 8/1988 | Layman et al. | |
| 4,951,892 A | | 8/1990 | Chaplin et al. | |
| 5,028,011 A | | 7/1991 | Schiffers | |
| 5,282,584 A | * | 2/1994 | Yano | 242/530.2 |

FOREIGN PATENT DOCUMENTS

| | | |
|---|---|---|
| EP | 0 860 391 A1 | 8/1996 |
| WO | WO 95/32908 | 12/1995 |
| WO | WO 98/55383 | 12/1998 |

* cited by examiner

*Primary Examiner*—William A. Rivera
(74) *Attorney, Agent, or Firm*—Frederick K. Lacher, Esq.; Bruce J. Hendricks, Esq.; The Goodyear Tire and Rubber Company

(57) ABSTRACT

A strip of sheet material is wound on a spool by a driving belt wrapped around spaced rollers of a surface winder which urge the sheet material into contact with the spool, rotating the spool, and at the same time, applying the sheet material to the spool, with layers of the material being separated by a liner wrapped around the spool as the sheet material is being applied.

8 Claims, 4 Drawing Sheets

SURFACE WINDING ON AN A-FRAME WINDER

TECHNICAL FIELD

This invention relates to winding a strip of sheet material such as a tire component on a spool which is transported to a tire building machine for building a tire. The spool may be mounted on a cart which also supports a liner shell for a liner which is interposed between the material wrapped around the wind-up shell of the spool of material.

BACKGROUND ART

Server systems, such as that shown in U.S. Pat. No. 4,951,892 for storing and delivering stock material are used in the tire manufacturing process. The handling, storage and transporting of the tire components on a spool mounted on an A-frame cart has obvious convenience advantages. There are also disadvantages such as the distortion of the material during winding on the spool. This is particularly true in winding a tread, where the contours of the tread are important and may be distorted in the winding-storage process. Belts that are wound on a spool may also be distorted and the ends-per-inch count of the wires in the belt may be altered such that the stored belt does not meet specifications and must be rejected. Also because the components are wound with a liner separating the layers, it has been found that the "square woven" components may be crushed and separation from the liner becomes difficult, if not impossible. Where calendered material is wound on the spool it may be distorted and flattened at the center of the roll and may have to be cut away from the liner, wasting expensive liner material and delaying the manufacturing process. These problems are believed to be due in part to the distortion caused by undue pressure applied in the wind up and storage process. Heretofore, center driven winders have been used to wind the spool by a motor which rotates a shaft connected to the wind-up shell of the spool. Winding tension control for applying and varying the tension applied to the component being wound on the spool is important because it must be varied as the spool grows in size and diameter during wind up.

Surface winders have also been used in some cases wherein the component is wound through contact with the surface of the spool by a moving belt. With traditional surface winders the spool is supported on a driving belt and the weight of the spool distorts the material unless an adjustable support is provided to lift the spool and take the weight off the driving belt. This is not desirable because the entire weight of the spool must be carried by the adjusting means.

In another system such as that shown in U.S. Pat. No. 4,746,076 the roll being wound is supported on a web extending between two rotatable supporting rollers. The roll is rotated by a separate winder drum which transmits the sheet of paper or cardboard to the roll and rotates the roll.

In accordance with one aspect of the invention there is provided apparatus for winding a strip of sheet material on a rotatable spool of sheet material comprising a surface winder having belt means movable into engagement with the strip of sheet material for application to the spool and for rotating the spool characterized by pressure means for moving the surface winder and the belt means toward the spool to urge the strip of sheet material against the spool, and belt drive means engageable with the belt means for delivering the strip of sheet material to the spool and rotating the spool to wind the strip of sheet material on the spool.

In accordance with another aspect of the invention, there is provided apparatus for winding a strip of sheet material on a rotatable spool comprising:

(a) a surface winder having belt means movable into engagement with the strip of sheet material for application to the spool and for rotating the spool characterized by:

(b) pressure means for moving the surface winder and the belt means toward the spool to urge the strip of sheet material against the spool, and belt drive means with the belt means for delivering the strip of sheet material to the spool and rotating the spool to wind the strip of sheet material on the spool.

In accordance with another aspect of the invention, there is provided the apparatus of claim 1 wherein said spool is mounted on a movable frame and said surface winder is mounted at a fixed position adjacent a conveyor for supplying said strip of sheet material.

DETAILED DESCRIPTION OF THE INVENTION

Figure 1:
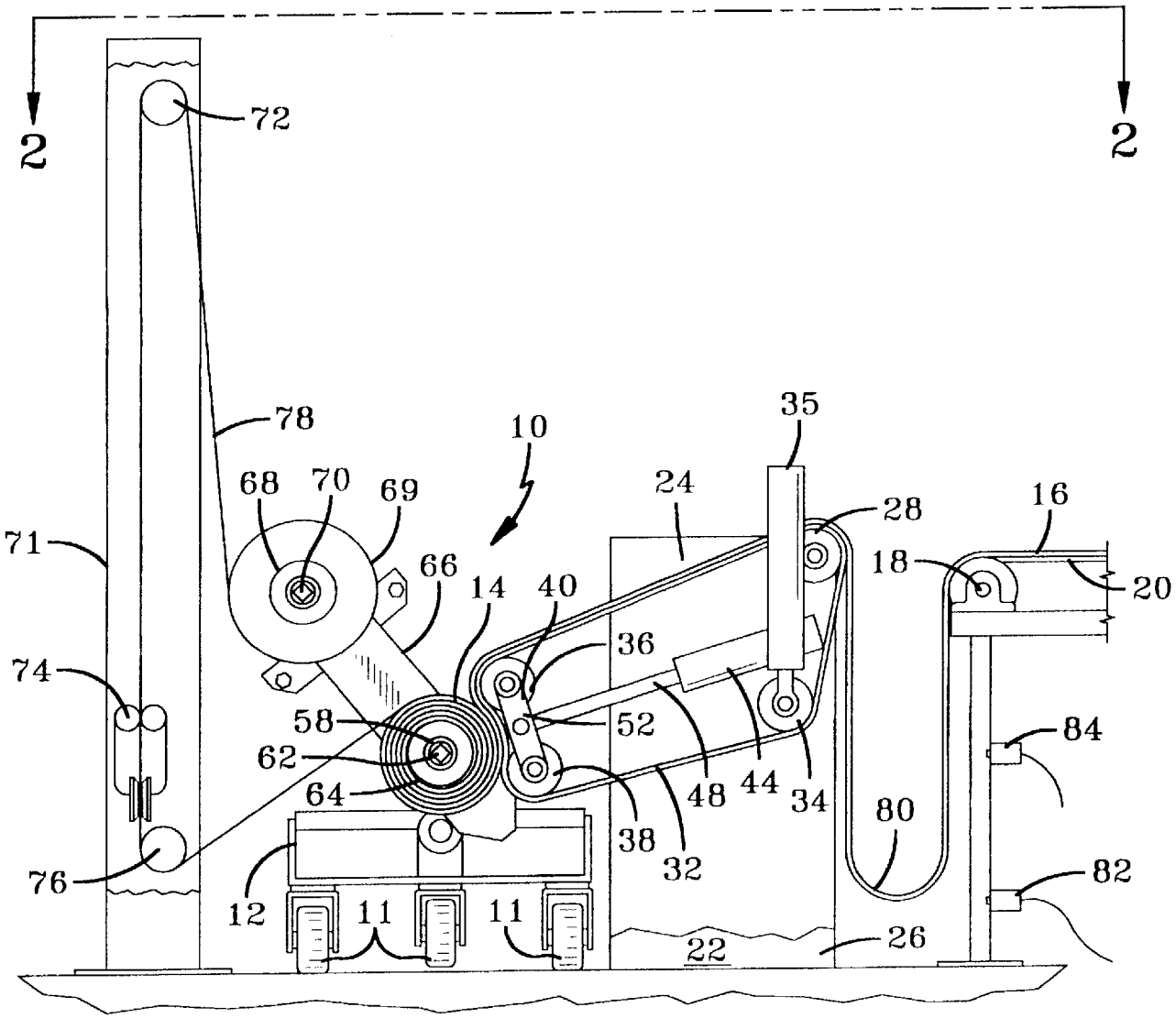
FIG. 1 is an end view of the wind up apparatus embodying the invention showing the surface winder apparatus at the start of the wind up process.
Figure 2:
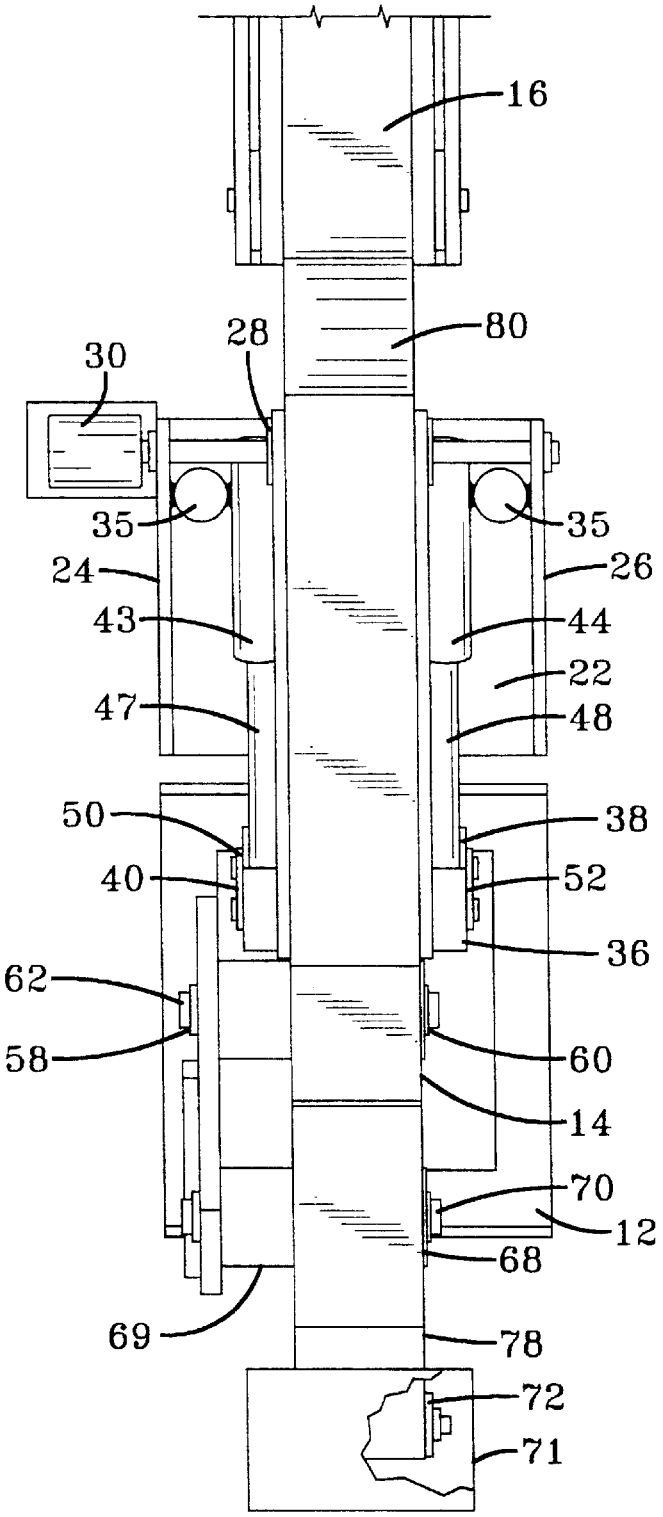
FIG. 2 is a plan view of the apparatus taken along line 2—2 in FIG. 1.
Figure 3:
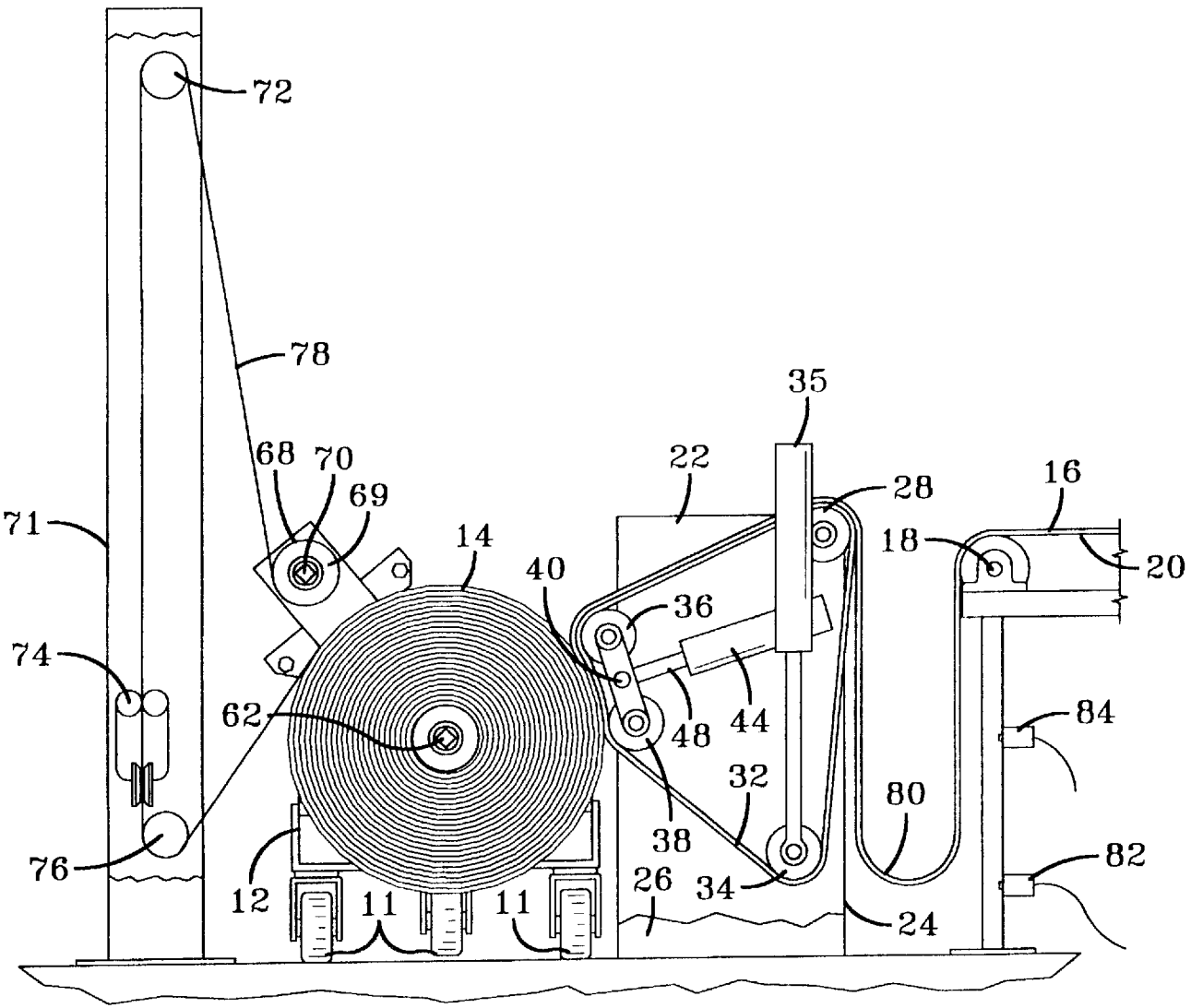
FIG. 3 is an end view like FIG. 1 showing the apparatus at the end of the wind up process.

Referring to FIGS. 1, 2 and 3, a wind-up apparatus 10 is shown having a movable cart frame 12, supported on a floor by wheels 11, for transporting a spool 14 of sheet material 16 from a wind-up position, such as that shown in the drawings, to a delivery or server position spaced from the wind-up position. Where the sheet material 16 is a tire component, such as a tread or ply, the sheet material may be conveyed to the wind-up position on a belt conveyor 18, where it is carried on a belt 20 to a position spaced from a sheet material applier frame 22 positioned adjacent to the movable cart frame 12.

The sheet material applier frame 22 has side plates 24 and 26 supporting a driving pulley 28 driven by a motor 30, or other driving means for driving a driving belt 32. The driving belt 32 is trained around the driving pulley 28, a take-up pulley 34 and a pair of spaced pulleys 36 and 38 of a surface winder 40. The take-up pulley 34, may be mounted on pressure controlled air cylinders 35,35 fastened to each of the side plates 24 and 26 with the weight of the take-up pulley and the pressure controlled air cylinders maintaining the driving belt 32 in tension.

The surface winder 40 has a pressure means such as a pair of piston cylinder assemblies 43 and 44 fastened to the side plate 24 and side plate 26 of the applier frame. The piston cylinder assemblies 43 and 44 have piston rods 47 and 48 attached to mounting plates 50 and 52 spaced apart and positioned at opposite ends of the spaced pulley 36 and spaced pulley 38 of the surface winder 40. The mounting plates 50 and 52 are rotatably mounted on the piston rods 47 and 48 whereby the spaced pulley 36 and spaced pulley 38 are radially movable to conform to the contour of the spool 14. Movement of the surface winder 40 towards the spool 14 is provided by the piston-cylinder assemblies 43 and 44.

The movable cart frame 12 of the wind-up apparatus 10 may have spaced bearings 58 and 60 for rotatably supporting a shaft 62 of a wind-up shell 64. Liner support arms 66 are mounted on the movable frame 12 and extend to a spaced apart position for supporting a liner sheel 68 of a liner roll 69 in bearing 70. Also supported on the floor are liner support members 71 attached to the material applier frame 22 at either side thereof for supporting a lead in roller 72, precision guide 74 and a lead out roller 76.

The wind-up apparatus 10 shown in FIG. 3 illustrates the apparatus with the spool 14 at the end of the wind-up operation.

Figure 4:
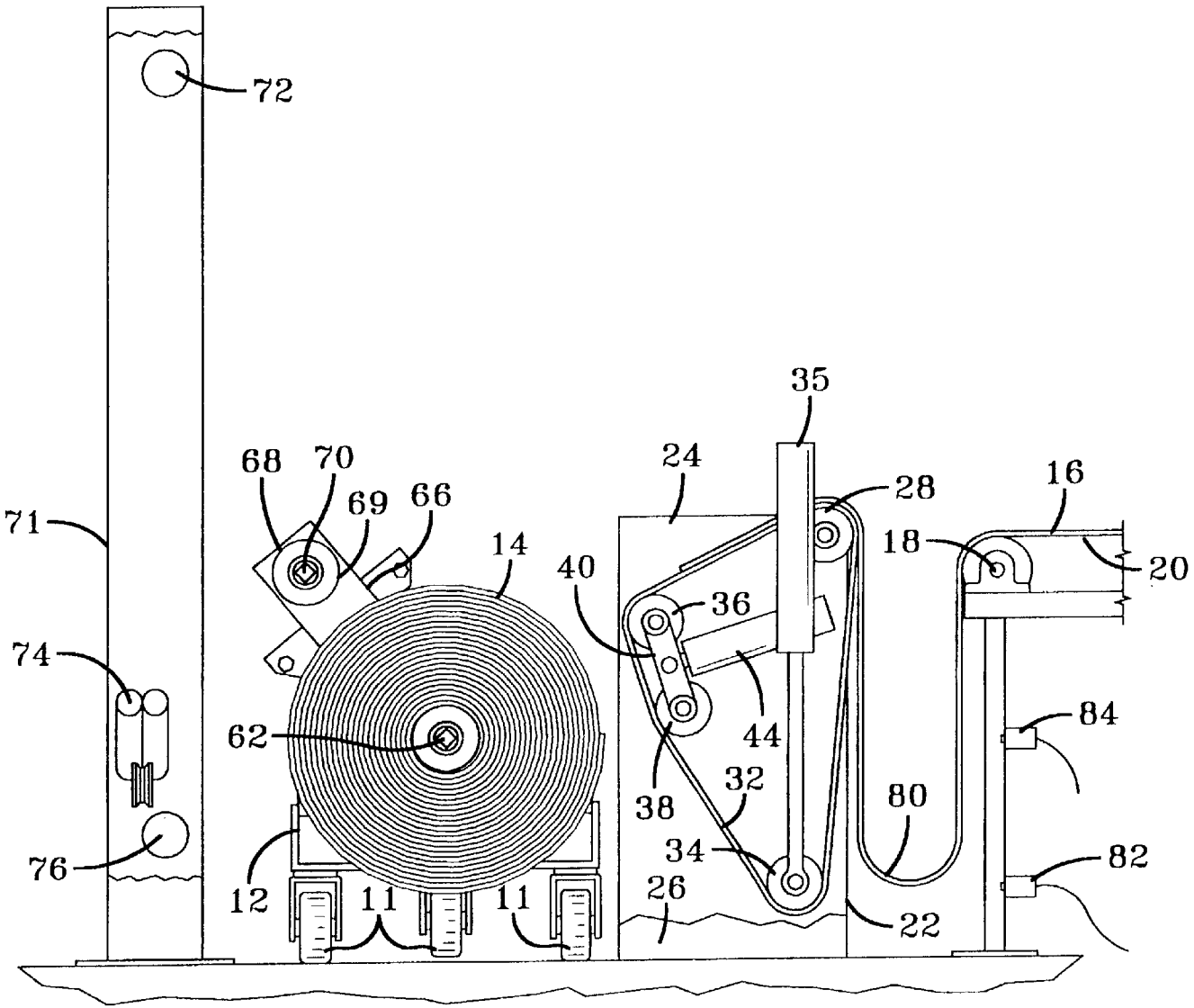
FIG. 4 is an end view like FIG. 1 showing the apparatus with the surface winder retracted for cart removal.

The wind-up apparatus 10 shown in FIG. 4 illustrates the apparatus with the spool 14 after the sheet material 16 and a liner 78 have been wrapped in a spool which may be transported to another location for delivering the sheet material or for storage. The location where the movable cart frame 12 is located, as shown in the drawings, is then open and available for another movable cart frame to be parked, and another spool wound up on an apparatus like that shown in FIGS. 1, 2 and 3.

In operation, the diameter of the spool 14 at the beginning of the wind-up operation is the diameter of the wind-up shell 64 as shown in FIGS. 1 and 2. The diameter of the liner roll 69 on the liner shell 68 is substantially greater than that shown in FIG. 1, but with the outer diameter spaced from the wind-up shell 64. The surface winder 40 maintains contact with the spool 14, as shown in FIG. 1, so that the spaced pulleys 36 and 38 urge the sheet material 16 on the driving belt 32 against the sheet material into contact with the liner 78 and rotate the spool 14 in a clockwise direction as shown in FIG. 1. The pivotal mounting of the spaced pulleys on the mounting plates 50 and 52 cause the driving belt 32 to conform with the surface of the spool 14 pressing the material 16 against the surface and at the same time, driving the spool in a clockwise directions. In this condition, the take-up pulley 34 is in a raised position as shown in FIG. 1.

As shown in the drawings, the driving belt 32 not only carries the sheet material 16 to the spool 14, but also remains in contact with the sheet material as it is applied to the spool. This provides the desired friction for turning the spool 14 with a controlled pressure from the piston-cylinder assemblies 43 and 44. The liner 78, which has one end wrapped around the spool 14, is pulled from the liner shell 68 over the lead in roller 72 through the precision guides 74 and over the lead out roller 76 so that it will be positioned accurately on the spool 14.

The conveyor 18, which may convey the sheet material 16 from a suitable source, such as an extruder or calender, may be driven by a separate drive and a festoon 80 is preferably provided between the conveyor belt 20 and the driving belt 32 to accommodate differences in the rate at which the sheet material is supplied by the conveyor 18 and the rate it is applied to the spool 14 by the driving belt 32. These differences in speed may be determined by the position of the festoon 80 as registered by photo eyes 82 and 84. The driving speed of the motor 30 connected to the driving pulley 28 and the driving speed of the motor for the conveyor 18 may then be adjusted accordingly.

Having thus described the invention, it is now claimed:

1. Apparatus for winding a strip of sheet material on a rotatable spool comprising:

(a) a surface winder having belt means movable into engagement with said strip of sheet material for application to said spool and for rotating said spool, (b) pressure means for moving said surface winder and said belt means toward said spool to urge said strip of sheet material against said spool, and belt drive means engageable with said belt means delivering said strip of sheet material to said spool and rotating said spool to wind said strip of sheet material on said spool.

2. The apparatus of claim 1 wherein said surface winder further comprises a pair of spaced mounting plates and a pair of spaced pulleys rotatably mounted on said mounting plates with said mounting plates being rotatably mounted on said pressure means at a position between said spaced pulleys providing equalized surface contact between said belt means and said portion of said strip of sheet material wrapped on said spool.

3. The apparatus of claim 2 further comprising said belt drive means including a drive pulley spaced from said spool and a take up pulley movably mounted between said drive pulley and said surface winder for maintaining tension in said driving belt.

4. The apparatus of claim 1 further comprising said spool being mounted on a frame, a liner shell rotatably mounted on said frame and means for delivering said liner material from said liner shell to a position on said spool between said strip of sheet material already wrapped on said spool and said strip of sheet material being applied to said spool.

5. The apparatus of claim 1 wherein said spool is mounted on a movable cart frame and said surface winder is mounted at a fixed position adjacent a conveyor for supplying said strip of sheet material.

6. A method of winding a strip of sheet material on a rotatable spool comprising:

(a) conveying said strip of sheet material on a belt means to a surface winder at said spool, (b) urging said surface winder and said belt means toward said spool to press said strip of material against said spool, comprising;

(c) driving said belt means to deliver and wind said strip of sheet material on said spool and to rotate said spool.

7. The method of claim 6 further comprising said belt means being wrapped around two spaced pulleys of said surface winder, for applying pressure against said strip of sheet material and against said spool and rotating said spool without distortion of said strip of sheet material applied to said spool.

8. The method of claim 6 comprising simultaneously winding a strip of liner material on said spool and conveying said liner material to a position on said spool between said strip of sheet material already wrapped on said spool and a portion of said strip of sheet material being conveyed and applied to said spool.

* * * * *